US008088016B2

(12) United States Patent
Murphy

(10) Patent No.: US 8,088,016 B2
(45) Date of Patent: Jan. 3, 2012

(54) HALF-PIPE WATER RIDE

(76) Inventor: Douglas Murphy, Glasgow (GB)

( * ) Notice: Subject to any disclaimer, the term of this patent is extended or adjusted under 35 U.S.C. 154(b) by 106 days.

(21) Appl. No.: 12/427,414

(22) Filed: Apr. 21, 2009

(65) Prior Publication Data

US 2009/0275416 A1 Nov. 5, 2009

Related U.S. Application Data

(60) Provisional application No. 61/124,933, filed on Apr. 21, 2008.

(51) Int. Cl.
*A63G 21/18* (2006.01)
*A63G 21/00* (2006.01)

(52) U.S. Cl. ..... 472/117; 472/128

(58) Field of Classification Search ..... 472/13, 472/116, 117, 128, 129; 104/69, 70, 53
See application file for complete search history.

(56) References Cited

U.S. PATENT DOCUMENTS

| | | | | |
|---|---|---|---|---|
| 5,213,547 | A * | 5/1993 | Lochtefeld | 472/117 |
| 5,453,054 | A * | 9/1995 | Langford | 472/88 |
| 6,375,578 | B1 * | 4/2002 | Briggs | 472/117 |
| 6,676,530 | B2 * | 1/2004 | Lochtefeld | 472/117 |
| 6,716,107 | B2 * | 4/2004 | Lochtefeld | 472/117 |

* cited by examiner

*Primary Examiner* — Kien Nguyen
(74) *Attorney, Agent, or Firm* — Greenberg Traurig, LLP

(57) ABSTRACT

Embodiments of the invention provide a half-pipe water ride for use by a rider. The half-pipe water ride includes an activity section with a substantially flat middle section, a first curved sidewall, and a second curved sidewall opposite the first curved sidewall. Water flows from a water delivery section through the middle section to a dewatering section. The rider can ride on the half-pipe water ride substantially perpendicular to the water flow from the first curved sidewall across the middle section to the second curved sidewall.

20 Claims, 11 Drawing Sheets

HALF-PIPE WATER RIDE

RELATED APPLICATIONS

This application claims priority under 35 U.S.C. §119 to U.S. Provisional Patent Application No. 61/124,933 filed on Apr. 21, 2008, the entire contents of which is incorporated herein by reference.

BACKGROUND

Artificial boarding rides include water rides where riders can boogie board, surf board, body board, knee board, skim board, etc. Such rides often include curved walls so that riders can propel themselves across or along the curved walls. Most conventional boarding rides use water in a sheet flow-type manner, where water jets at the tops of the curved walls disperse water down the curved walls.

SUMMARY

Some embodiments of the invention provide a half-pipe water ride for use by a rider. The half-pipe water ride includes an activity section with a substantially flat middle section, a first curved sidewall extending from an edge of the middle section, and a second curved sidewall extending from another edge of the middle section opposite the first curved side. The half-pipe water ride also includes a water delivery section coupled to a side of the middle section and a dewatering section coupled to another side of the middle section opposite the water delivery section. Water flows from the water delivery section through the middle section to the dewatering section. The rider can ride on the half-pipe water ride substantially perpendicular to the water flow from the first curved sidewall across the middle section to the second curved sidewall.

DETAILED DESCRIPTION

Figure 1:
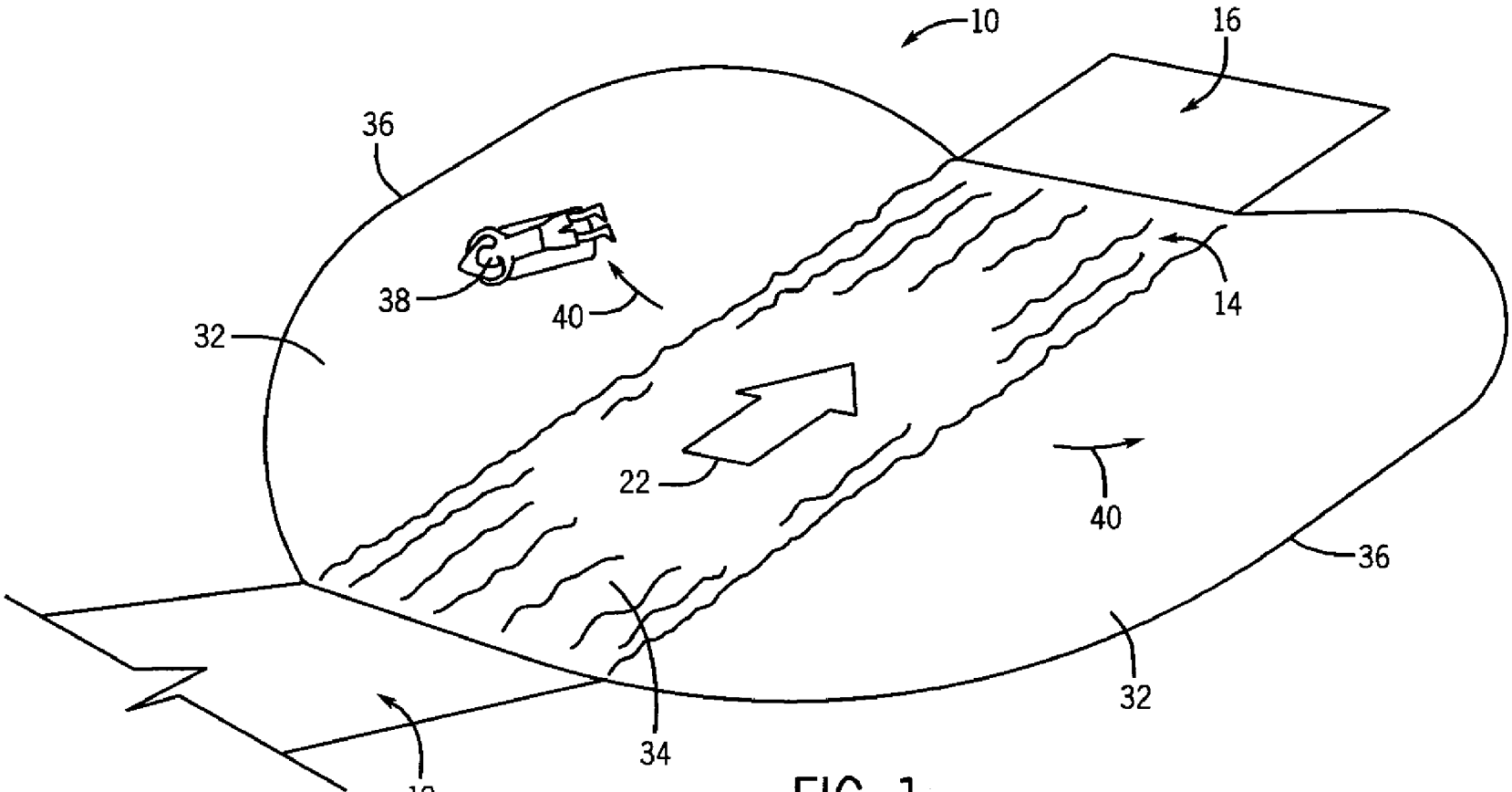
FIG. 1 is a perspective view of a water ride according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
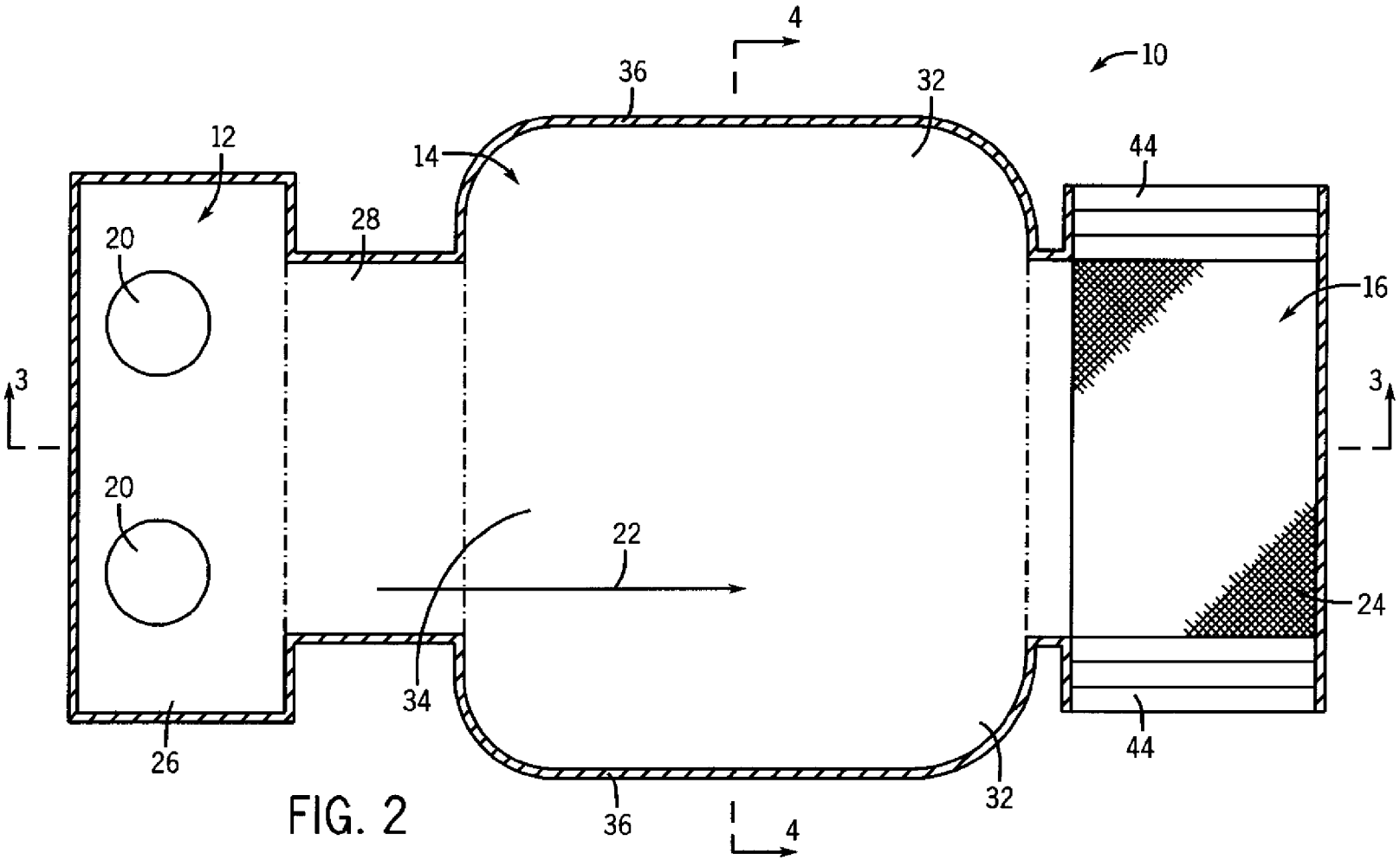
FIG. 2 is top view of the water ride of FIG. 1.
Figure 3:
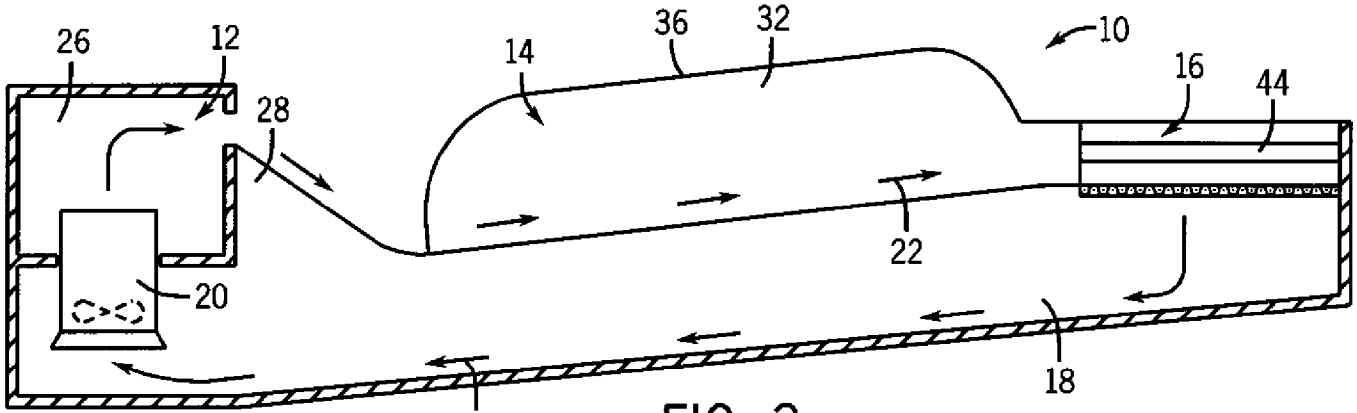
FIG. 3 is a side view of the water ride of FIGS. 1 and 2 taken along line 3-3 of FIG. 2.

FIGS. 1-4 illustrate a half-pipe water ride 10 according to one embodiment of the invention. The half-pipe water ride 10 can include a water delivery section 12, an activity section 14, a dewatering section 16, and a water retrieval section 18 (shown in FIG. 3). In some embodiments, a pump 20 can be used to circulate water through the half-pipe water ride 10 in the direction shown by arrows 22 in FIGS. 1-3. For example, water can be released at the water delivery section 12 and flow through the activity section 14 to the dewatering section 16. The water can then flow through a flat grate 24 in the dewatering section 16 into the water retrieval section 18 and back to the water delivery section 12 via the pump 20. In some embodiments, the flat grate 24 can also incorporate a soft mat (not shown). In some embodiments, the water retrieval section 18 can be positioned substantially below the water delivery section 12, the activity section 14, and the dewatering section 16, as shown in FIG. 3. FIG. 5 also shows an embodiment of the half-pipe water ride 10 where the water retrieval section 18 is positioned substantially below the water delivery section 12, an inclined activity section 14, and the dewatering section 16.

Figure 5:
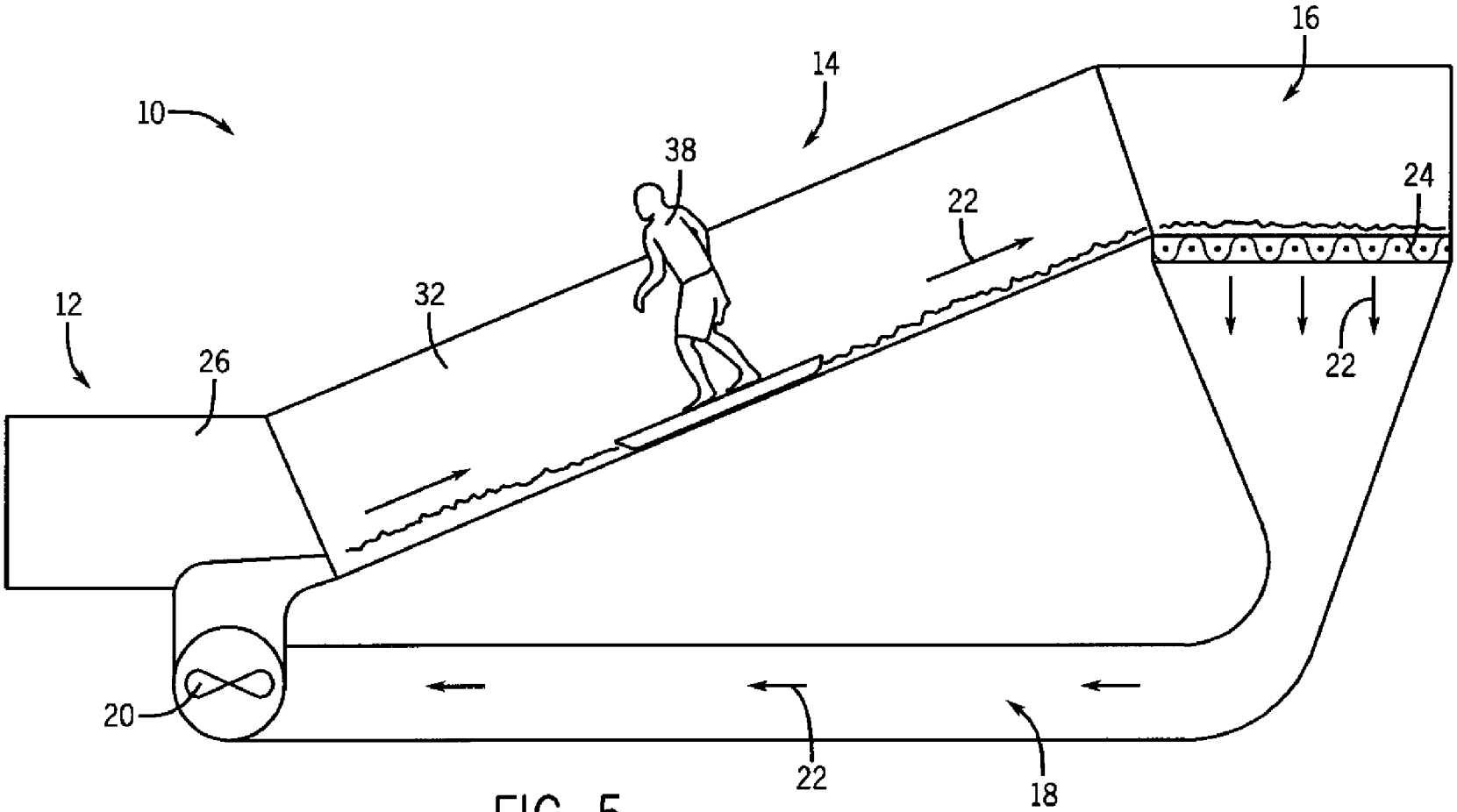
FIG. 5 is a side view of a water ride according to another embodiment of the invention.
Figure 6:
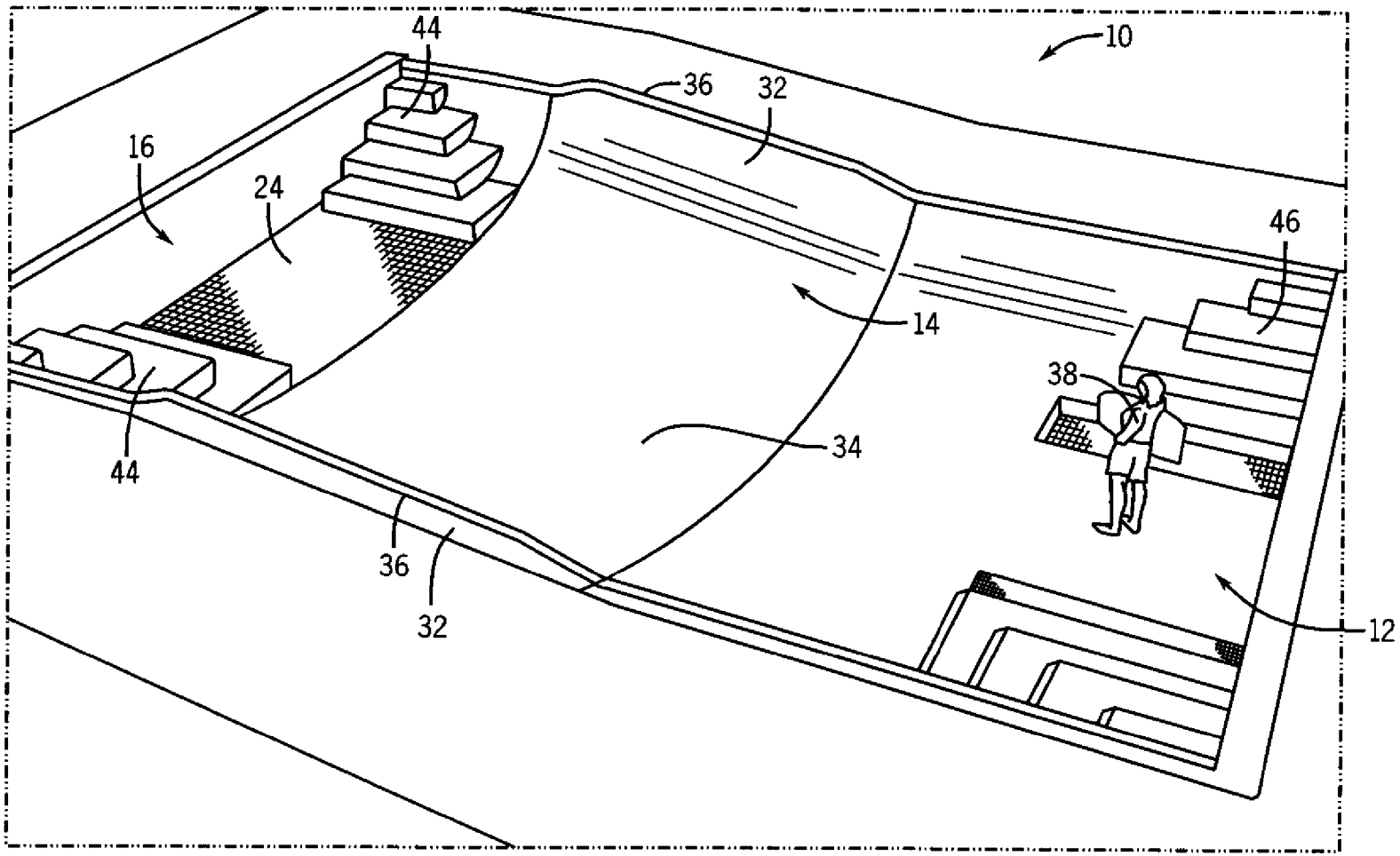
FIG. 6 is a perspective view of a water ride according to another embodiment of the invention.

As shown in FIGS. 2 and 3, the water delivery section 12 can include pumps 20, a water tank 26, and a ramp 28. The pumps 20 can pump water from the water retrieval section into the water tank 26. As the water tank 26 fills, water can be released down the ramp 28. In some embodiments, as shown in FIGS. 5-6, a nozzle assembly (not shown) can supplement or replace the water tank 26 and/or the ramp 28.

Figure 7:
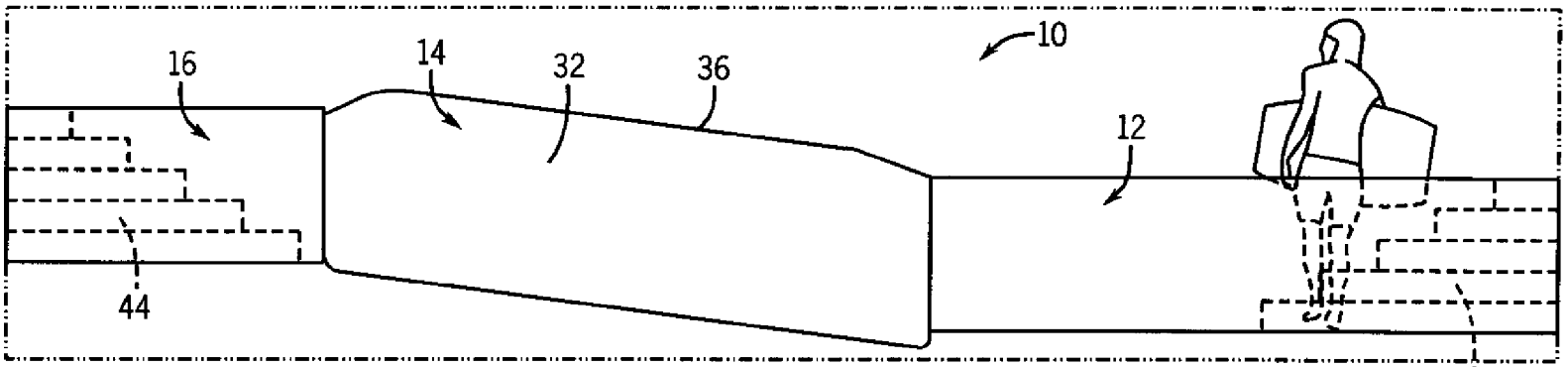
FIG. 7 is a side view of the water ride of FIG. 6.
Figure 8:
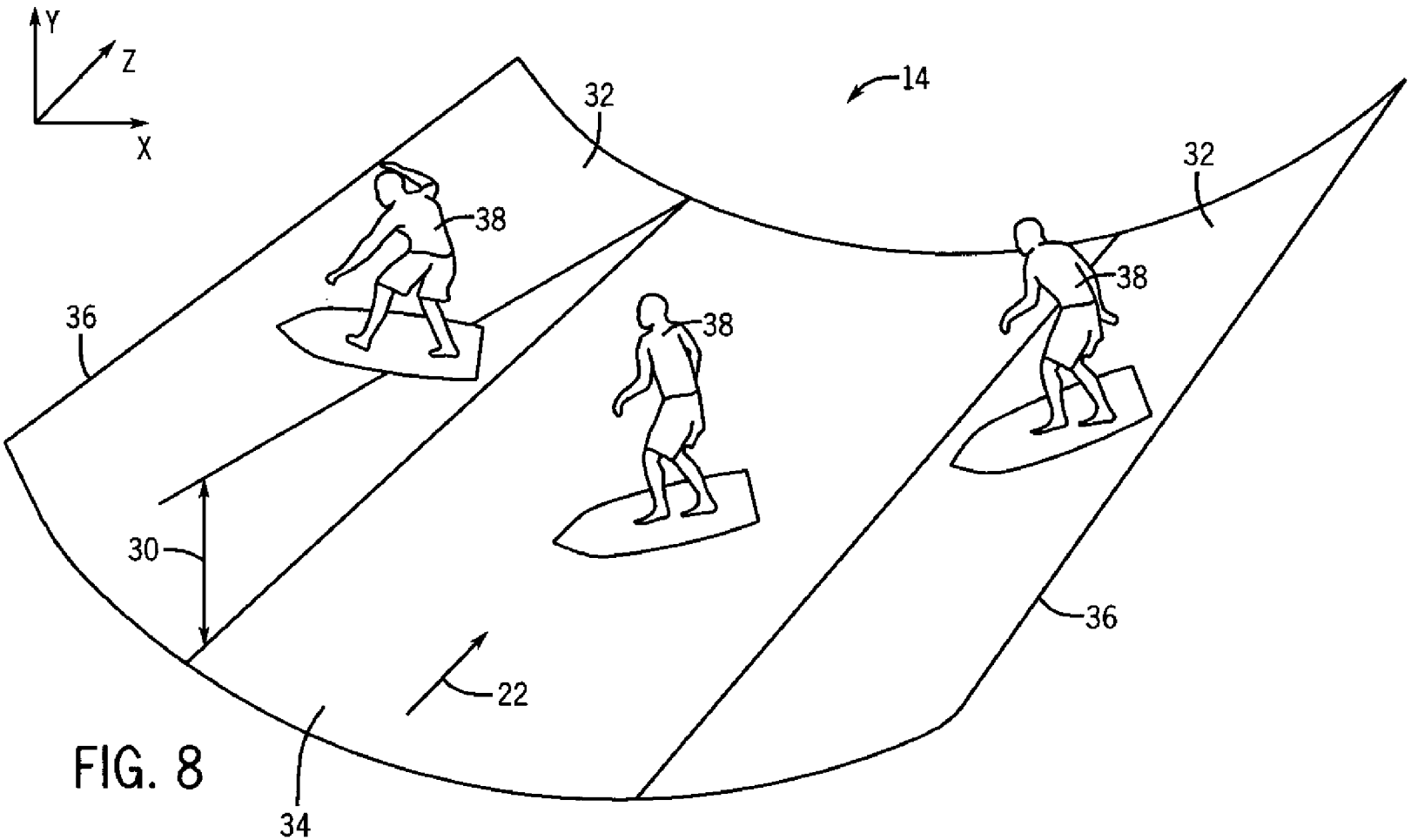
FIG. 8 is a perspective view of an activity section of the water ride of FIG. 1.

As shown in FIG. 7, the activity section 14 can slope upward from the water delivery section 12 to the dewatering section 16 so that water flows at an incline toward the dewatering section 12. The incline can allow the dewatering section 12 to be substantially above the water level in the activity section 14. For example, as shown in FIG. 8, an arrow 30 shows a change in depth (i.e., in the Y direction with respect to the vertices in FIG. 8) along the length (i.e., along the Z direction with respect to the vertices in FIG. 8) of the activity section 14.

Figure 4:
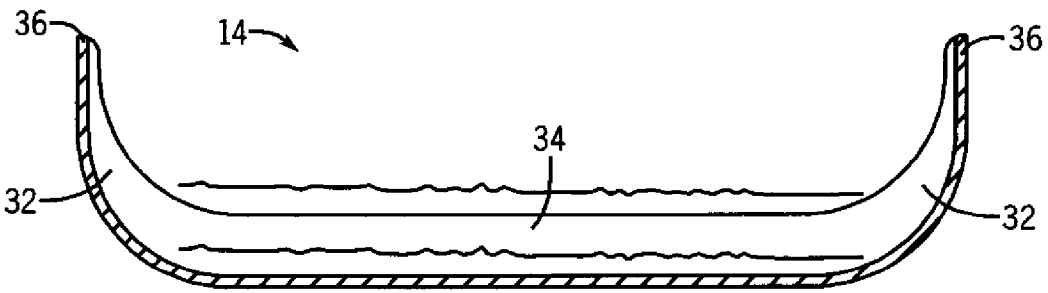
FIG. 4 is a cross-sectional view of the water ride of FIGS. 1-3 taken along line 4-4 of FIG. 2.
Figure 9:
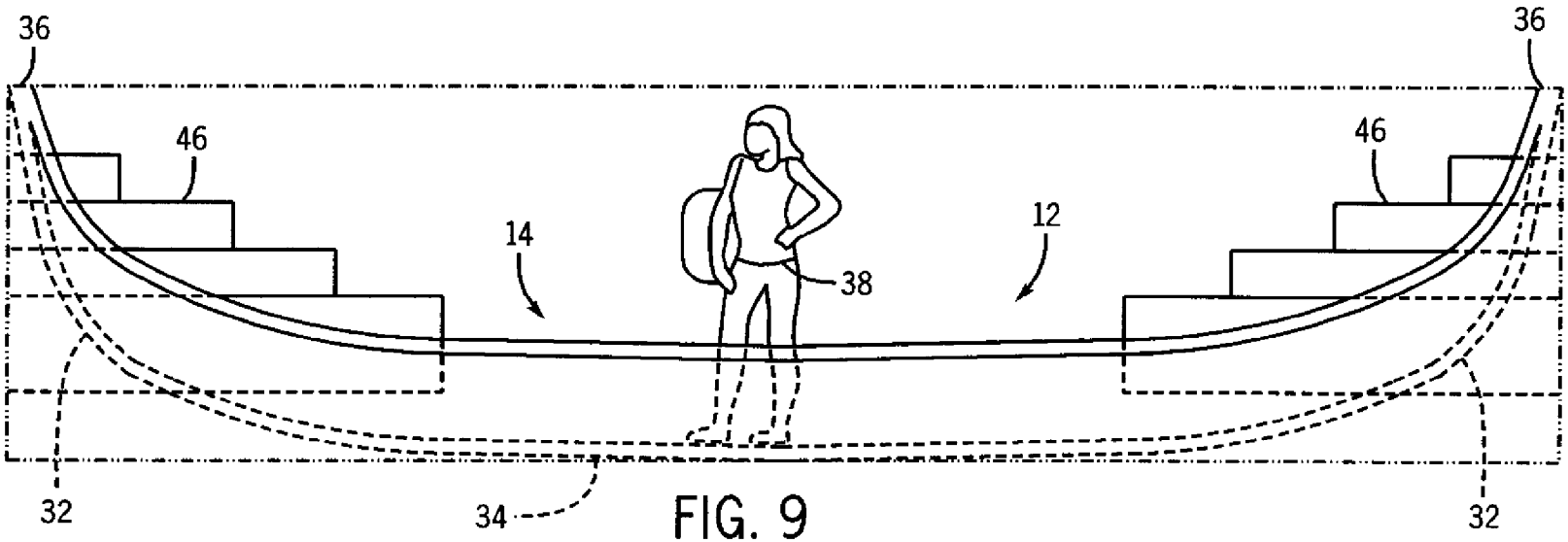
FIG. 9 is a front view of an activity section of the water ride of FIG. 6.
Figure 10:
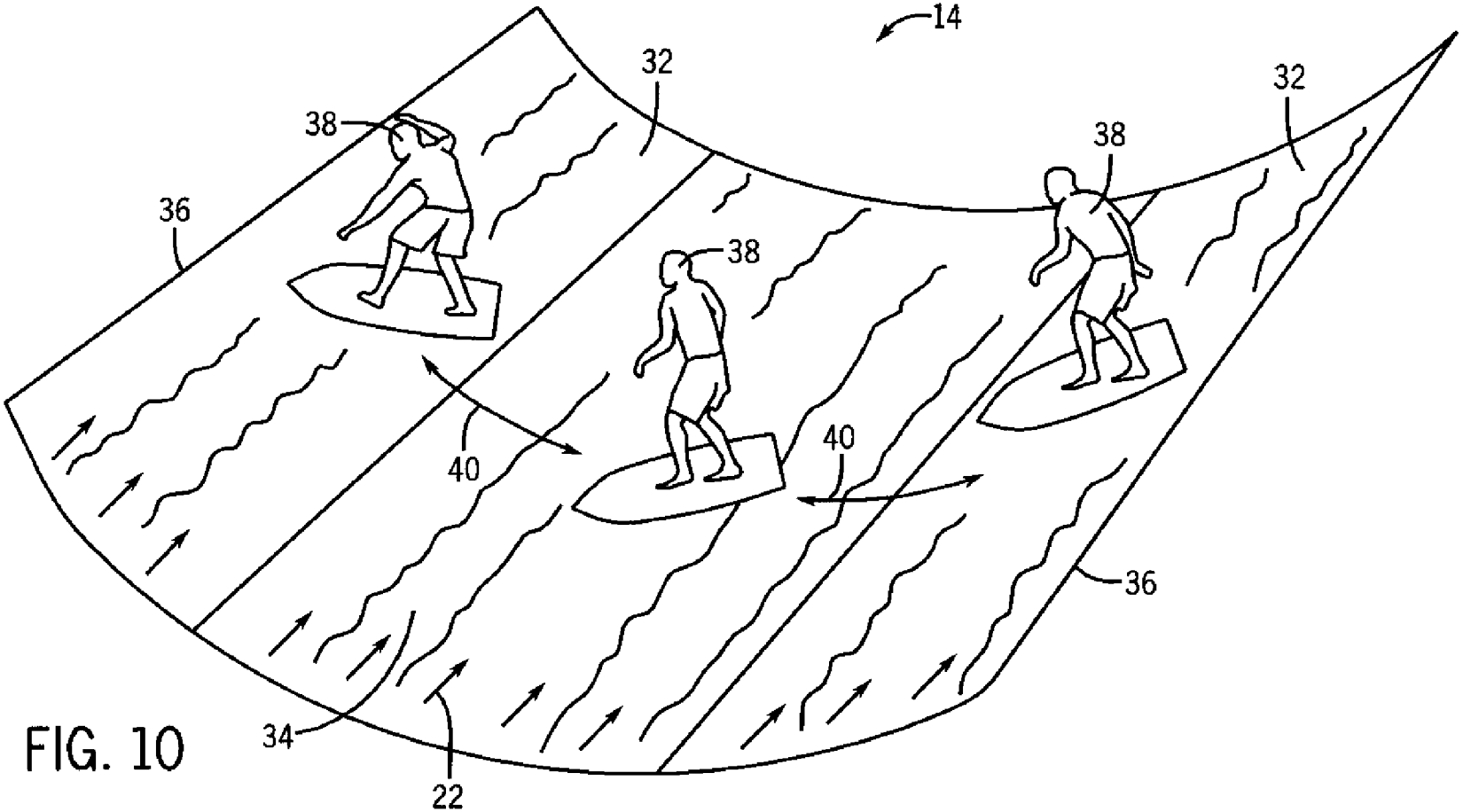
FIG. 10 is another perspective view of an activity section of the water ride of FIG. 1.
Figure 11:
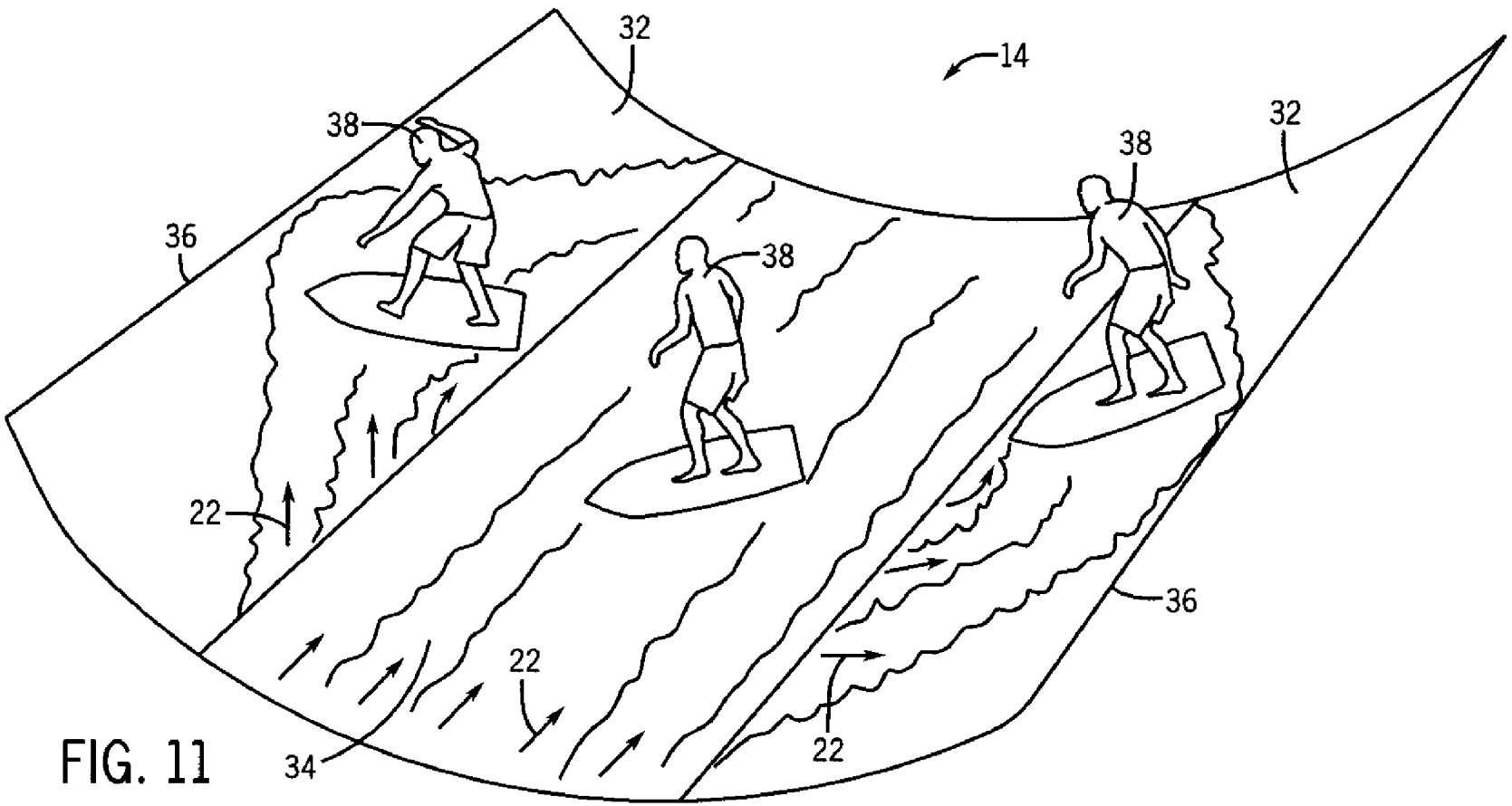
FIG. 11 is another perspective view of an activity section of the water ride of FIG. 1.

FIG. 4 illustrates a cross section of the activity section 14. FIG. 9 illustrates a cross section of the activity section 14 including the water delivery section 12. As shown in FIGS. 4, 8, and 9, the activity section 14 can have sidewalls 32 that are substantially curved. In some embodiments, each sidewall 32 can have the same radius of curvature. In other embodiments, the sidewalls 32 can be curved differently, effectively having different radii of curvature. The sidewalls 32 can be curved about an axis that is parallel to water flow in the half-pipe water ride 10. For example, water from the water delivery section 12 can flow along a middle section 34 of the activity section 14 between the sidewalls 32, as shown in FIG. 1. In some embodiments, water can also flow from top portions 36 of each sidewall 32. However, as all water can exit via the dewatering section 16, the main direction of water flow can be from the water delivery section 12 toward the dewatering section 16, as shown by the arrows 22. Also, in some embodiments, as shown in FIG. 10, water can be delivered from the water delivery section 12 along the full width of the activity section 14, including the sidewalls 32. In other embodiments, as shown in FIG. 11, water can be directed outward from the water delivery section 12 so that water flow is only directed along part of the sidewalls 32.

In some embodiments, water from the water delivery section 12 can flow at speeds between about ten miles per hour and about twenty miles per hour. Other embodiments can include faster or slower speeds of water flow. The water depth within the half-pipe water ride 10 can be substantially shallow (e.g., between about one inch and about twelve inches). In some embodiments, the water depth in the middle section 34 can be substantially deeper than other parts of the half-pipe water ride 10.

A rider 38 is shown in FIG. 1 and FIGS. 5-12. The rider 38 can use any one of a boogie board, surf board, body board, knee board, skim board, etc. Once in the activity section 14, the rider 38 can propel himself up onto the sidewalls 32. In essence, the rider 38 can move left and right at approximately 90 degrees to the direction of the main water flow, as shown by arrows 40 in FIG. 1. Further, by gathering speed, the rider 38 can ride higher onto the sidewalls 32. The rider 38 can use the sidewalls 32 for turning or other maneuvers similar to riders using conventional snowboard half-pipes or skateboard half-pipes.

Figure 12A:
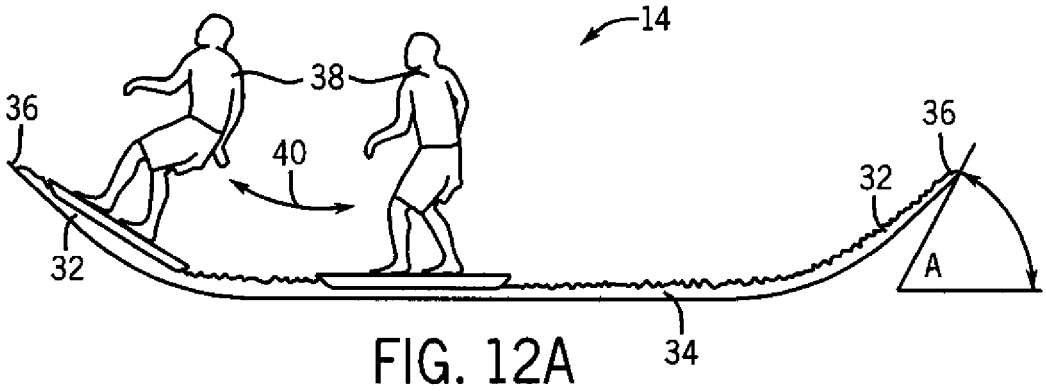
FIG. 12A is a side view of an activity section of a water ride according to one embodiment of the invention.
Figure 12B:
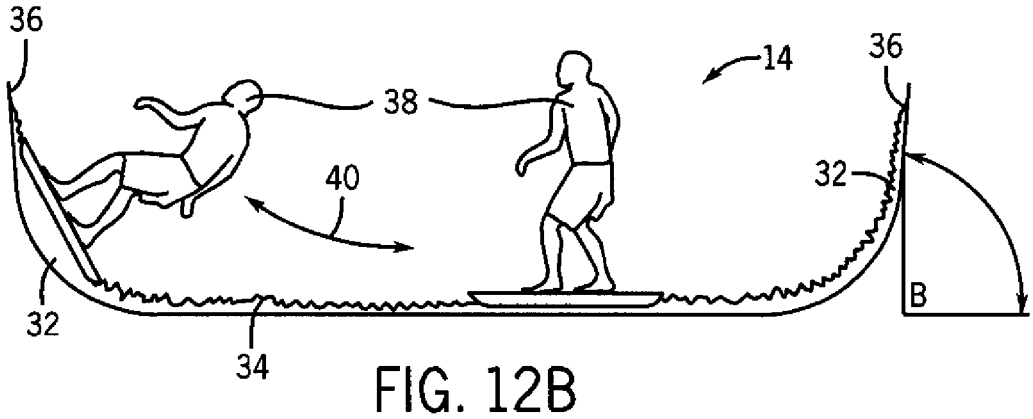
FIG. 12B is a side view of an activity section of a water ride according to another embodiment of the invention.
Figure 12C:
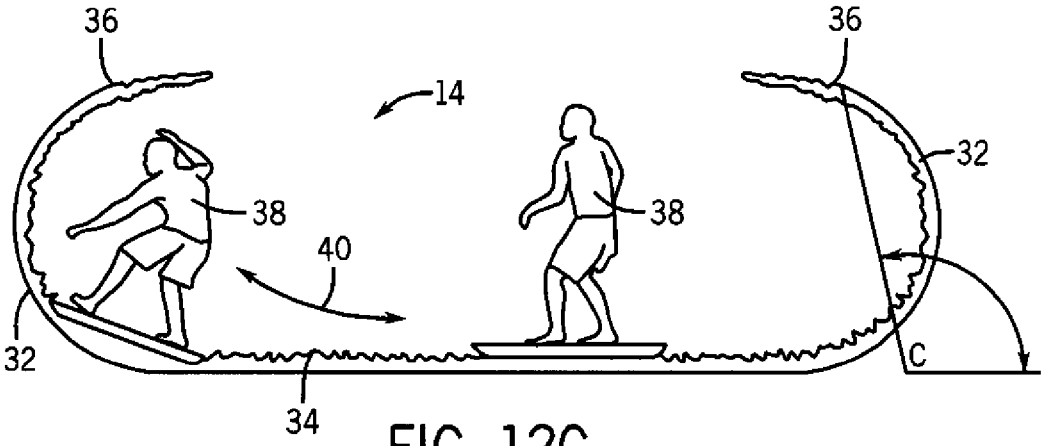
FIG. 12C is a side view of an activity section of a water ride according to yet another embodiment of the invention.

The amount of curvature of the sidewalls 32 can depend on the intended use of the half-pipe water ride 10. For example, as shown in FIG. 12A, the sidewalls 32 can be shallow (e.g., where an angle A, shown with respect to the top portion 36 of the sidewall 32 and the middle section 34, can be less than about ninety degrees). The sidewalls 32 as shown in FIG. 12A can be for general use. In another example, as shown in FIG. 12B, the sidewalls 32 can be substantially vertical (e.g., where an angle B, shown with respect to the top portion 36 and the middle section 34, can be about ninety degrees). The sidewalls 32 as shown in FIG. 12B can be for more extreme use than the sidewalls 32 shown in FIG. 12A. In yet another example, as shown in FIG. 12C, the sidewalls 32 can substantially curved over, creating an overhead section (e.g., where an angle C, shown with respect to the top portion 36 and the middle section 34, can be more than about ninety degrees). The sidewalls 32 as shown in FIG. 12C can be used to simulate barreling overhead waves.

In some embodiments, the activity section 14 can have sidewalls 32 with varied curvatures, so that different portions of the sidewalls 32 are curved differently. For example, the half-pipe water ride 10 can include a first portion where the sidewalls 32 are curved as shown in FIG. 12A, a second portion where the sidewalls 32 are curved as shown in FIG. 12B, and a third portion where the sidewalls 32 are curved as shown in FIG. 12C. In some embodiments, the rider 38 can then choose the portion (i.e., first, second, or third portion) best suited to his or her ability or liking.

Figure 13:
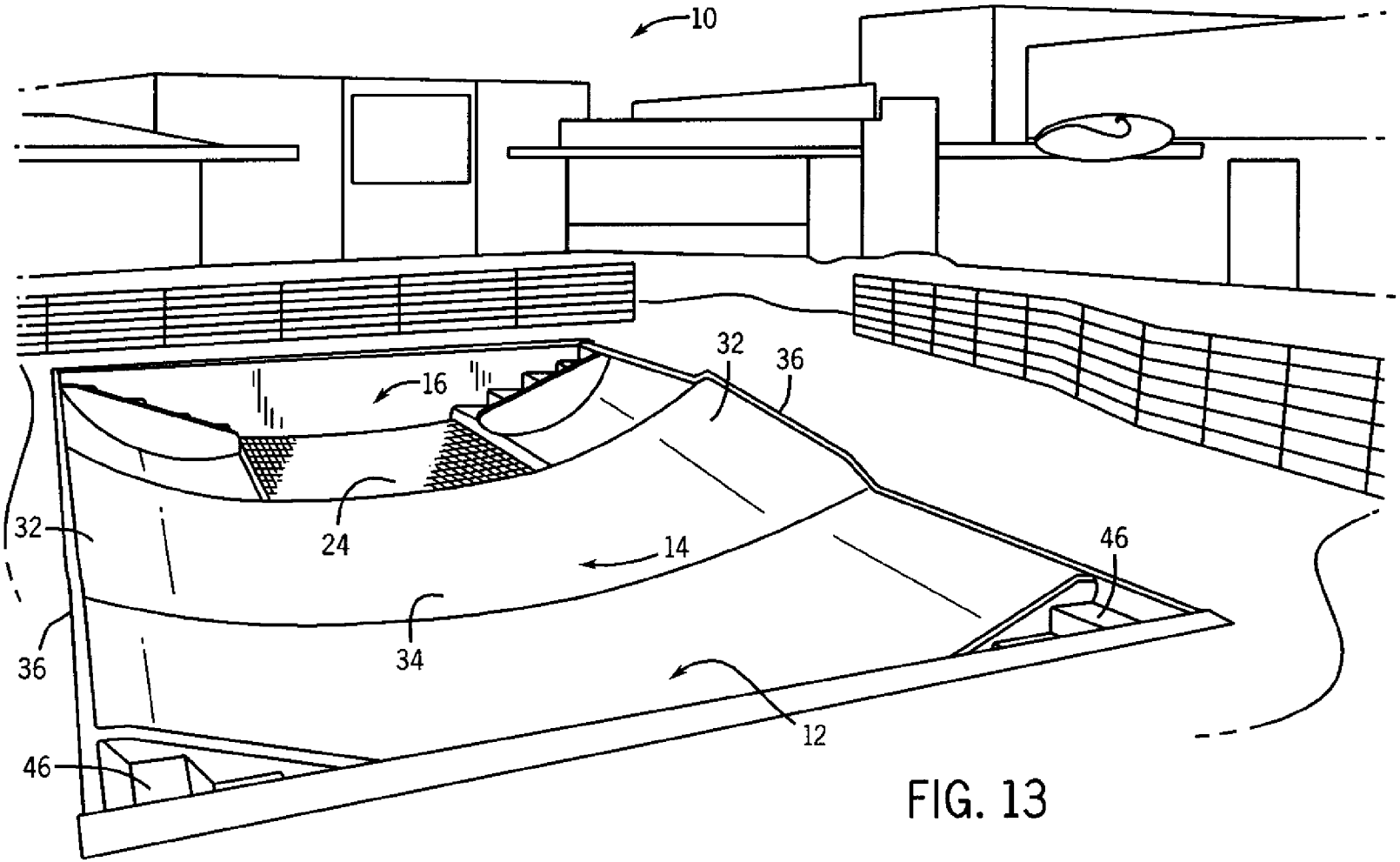
FIG. 13 is a perspective view of a water ride according to another embodiment of the invention.

As the water flow can propel the rider 38 into the dewatering section 16, the soft mat on top of, or incorporated with, the flat grate 24 of the dewatering section 16 can safely help the rider 38 stop. The rider 38 can enter and/or exit the half-pipe water ride 10 via stairs 44 along one or both sides of the dewatering section 16, as shown in FIGS. 2, 3, 6, 7, and 13. Alternatively, in some embodiments, there can be a ramp (not shown) on one or both sides of the dewatering section 16 for the rider 38 to enter and/or exit the half-pipe water ride 10. In addition, the rider 38 can enter and/or exit the half-pipe water ride 10 via stairs 46 near the water delivery section 12, as shown in FIGS. 6, 9, and 13.

FIG. 13 illustrates the half-pipe water ride 10 incorporated into a leisure facility, such as a water park. In some embodiments, the half-pipe water ride 10 can be about eight meters wide, where the middle section 34 is about four meters wide and each sidewall 32 is about two meters wide. However, the half-pipe water ride 10 can be scaled up or down depending on its general use and/or the facility. Also, in some embodiments, the activity section 14, or the entire half-pipe water ride 10, can be constructed of fiberglass panels. In other embodiments, at least portions of the half-pipe water ride 10 can be constructed of concrete covered in a protective padding. In still other embodiments, the half-pipe water ride 10 can be inflatable.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A water ride for use by a rider, the water ride comprising:

an activity section including a substantially flat middle section, a first curved sidewall extending substantially upwardly from an edge of the middle section, and a second curved sidewall extending substantially upwardly from another edge of the middle section opposite the first curved side;

a water delivery section coupled to a side of the middle section; and the water delivery section configured and arranged to deliver water up the middle section in a direction substantially opposite the rider's direction of travel along the middle section;

a dewatering section coupled to another side of the middle section opposite the water delivery section and located at an elevation higher than the water delivery section; and a rider exit located adjacent the water delivery section.

2. The water ride of claim 1 wherein the water delivery section includes a water delivery tank and a delivery ramp.

3. The water ride of claim 1 wherein the water delivery section includes a nozzle.

4. The water ride of claim 1 and further comprising a water retrieval section that carries water from the dewatering section back to the water delivery section.

5. The water ride of claim 4 wherein the water retrieval section is positioned under at least one of the dewatering section, the activity section, and the water delivery section.

6. The water ride of claim 1 wherein additional water flows from top portions of the first curved sidewall and the second curved sidewall toward the middle section.

7. The water ride of claim 1 wherein the first curved sidewall and the second curved sidewall have a substantially equal radius of curvature.

8. The water ride of claim 1 wherein the first curved sidewall and the second curved sidewall have different radii of curvature.

9. The water ride of claim 1 wherein the first curved sidewall and the second curved sidewall are curved about an axis parallel to water flow, and are connected by a substantially flat activity section.

10. The water ride of claim 1 wherein the rider exit comprises stairs.

11. The water ride of claim 1 wherein the water delivery section delivers water toward the activity section at a speed between about 10 miles per hour and about 20 miles per hour.

12. The water ride of claim 1 wherein a depth of water in the middle section is between about 1 inch and about 12 inches.

13. The water ride of claim 1 wherein the activity section is constructed of fiberglass panels.

14. The water ride of claim 1 wherein the activity section is constructed of concrete covered by a soft padding.

15. The water ride of claim 1 wherein at least one of the first curved sidewall and the second curved sidewall is curved at an angle of at least one of greater than ninety degrees, about ninety degrees, and less than ninety degrees.

16. The water ride of claim 1 wherein the dewatering section is substantially flat and includes at least one of a grate and a soft mat.

17. The water ride of claim 1 wherein the activity section is about eight meters wide.

18. The water ride of claim 1 wherein the middle section is about four meters wide.

19. The water ride of claim 1 wherein at least one of the first curved sidewall and the second curved sidewall is about two meters wide.

20. A water ride for use by a rider, the water ride comprising:

an activity section including a substantially flat, inclined middle section, a first curved sidewall extending substantially upwardly from an edge of the middle section, and a second curved sidewall extending substantially upwardly from another edge of the middle section opposite the first curved side;

a water delivery section coupled to a side of the middle section;

the water delivery section including at least one nozzle configured and arranged to deliver water up the entire length of the middle section;

a dewatering section coupled to another side of the middle section opposite the water delivery section and located at an elevation higher than the water delivery section; and a rider exit located adjacent the water delivery section.

* * * * *